US006440006B1

(12) United States Patent
Johnson

(10) Patent No.: US 6,440,006 B1
(45) Date of Patent: Aug. 27, 2002

(54) NEGATIVE LOFT FULCRUM-BALANCED PUTTER

(76) Inventor: Vernon R. Johnson, P.O. Box 660, Grand Haven, MI (US) 49417

( * ) Notice: Subject to any disclaimer, the term of this patent is extended or adjusted under 35 U.S.C. 154(b) by 0 days.

(21) Appl. No.: 09/644,739

(22) Filed: Aug. 23, 2000

(51) Int. Cl.[7] ..... A63B 53/04; A63B 69/36

(52) U.S. Cl. ..... 473/252; 473/306; 473/340; 473/336; 473/313

(58) Field of Search ..... 473/238, 242, 473/244, 245, 250, 251, 252, 253, 254, 256, 306, 305, 313, 324, 325, 330, 334, 336, 337, 340, 341, 349, 350, 307

(56) References Cited

U.S. PATENT DOCUMENTS

| | | | | |
|---|---|---|---|---|
| 1,291,967 | A | * | 1/1919 | McDougal |
| 1,756,219 | A | * | 4/1930 | Spiker |
| 3,497,220 | A | | 2/1970 | Scott |
| 4,077,633 | A | | 3/1978 | Studen |
| D251,027 | S | * | 2/1979 | Cruger |
| D252,649 | S | | 8/1979 | Bernhardt |
| 4,163,554 | A | | 8/1979 | Bernhardt |
| D257,782 | S | | 1/1981 | Bernhardt |
| D257,783 | S | | 1/1981 | Bernhardt |
| D259,134 | S | | 5/1981 | Bernhardt |
| 4,265,451 | A | | 5/1981 | Bernhardt |
| D275,214 | S | | 8/1984 | Bernhardt |
| D275,215 | S | | 8/1984 | Bernhardt |
| D275,216 | S | | 8/1984 | Bernhardt |
| D275,217 | S | | 8/1984 | Bernhardt |
| D275,591 | S | | 9/1984 | Bernhardt |
| D275,592 | S | | 9/1984 | Bernhardt |
| 4,506,888 | A | * | 3/1985 | Nardozzi |
| 4,664,385 | A | | 5/1987 | Macera |
| 4,795,158 | A | | 1/1989 | Kuykendall |
| 4,828,266 | A | | 5/1989 | Tunstall |
| 4,866,979 | A | | 9/1989 | Bernhardt |
| 4,962,931 | A | * | 10/1990 | Jazdzyk |
| 5,228,332 | A | | 7/1993 | Bernhardt |
| 5,290,035 | A | * | 3/1994 | Hannon |
| 5,344,149 | A | | 9/1994 | Miller |
| 5,489,097 | A | * | 2/1996 | Simmons |
| 5,676,603 | A | * | 10/1997 | Miller |
| 5,690,556 | A | * | 11/1997 | Condon |
| 5,839,974 | A | * | 11/1998 | McAllister |
| 5,857,922 | A | | 1/1999 | Delio |
| 5,928,088 | A | | 7/1999 | Matthews |
| 6,001,024 | A | * | 12/1999 | Van Alen |
| 6,083,113 | A | | 7/2000 | Bernhardt |

* cited by examiner

*Primary Examiner*—Sebastiano Passaniti
(74) *Attorney, Agent, or Firm*—Price, Heneveld, Cooper, DeWitt & Litton

(57) ABSTRACT

A golf putter comprising a shaft having a handle end and an at least partially threaded putter head end wherein the handle end and the putter head end of the shaft are at a shaft angle from about 10 degrees to about 20 degrees to one another, a putter head of a first density having a ball striking side, a rear side, two ends, two upwardly extending ears each having at least one golf ball guide receiving slot, a top surface, a bottom surface, a top half and a bottom half wherein the ball striking side of the putter extends upward from the bottom surface at an angle of 89–86 degrees from the bottom surface thereby creating an angle that imparts top spin to a golf ball when stuck by the ball striking side of the putter head, at least one golf ball guide positioned within the golf ball guide receiving slots, at least one, a weight having a second density where the second density is greater than the first density of the putter head wherein the weight is within the channel thereby lowering the center of gravity of the putter head below the center of the putter head, and wherein the top surface of the putter head includes a recess adapted to receive and interact with the putter head end of the shaft.

36 Claims, 3 Drawing Sheets

NEGATIVE LOFT FULCRUM-BALANCED PUTTER

BACKGROUND OF THE INVENTION

The invention generally relates to golf clubs, specifically a golf putter. Numerous golf putters have been designed since the game was invented at least 500 years ago. The goal of every putter design is to provide a natural, accurate, and an easily swung club that has excellent feel and a large sweet spot on the head of the putter for striking the golf ball. All of these features assist the golfer in the mechanics involved in putting and execution of a putt thereby increasing the chance that the golfer will make a successful putt. There have been a great variety of patents on golf ball putters and golf ball putter heads.

U.S. Pat. No. 5,928,088 to Matthews, entitled "Golf Putter Head," is directed toward a putter head specifically having a narrow length to minimize sidespin and stubbing. The putter head also has a negative loft striking face with a center of gravity above the midpoint of the striking face. The small size of the striking face makes it difficult to strike the ball squarely. Moreover, since the center of gravity of the putter head is above the midpoint of the striking face, the negative loft (topspin) induced by the head is not optimized and the feel of the putter is poor.

U.S. Pat. No. 4,077,633 to Studen, entitled "Golf Putter" is directed toward a golf putter with a putter head with a conventional handle shaft attached to a proximal end thereof. The putter head striking face has two slanted segments. A weight is disposed in a recess formed upwardly into the bottom of the head. The weight of the head and the conventional handle shaft combine to form a putter that does not have an easy feel to the golfer. The distal end of the putter head extends out very far from the golfer, creating unnatural stress on the golfer's shoulder muscles, which causes variations in swing from putt to putt. This makes accurate putting very difficult. Consequently, there is a significant need for a putter with a specifically designed head and shaft combination that provides a comfortable, replicable swing, that also provides accurate alignment and a large sweet spot on the putter head.

SUMMARY OF THE INVENTION

In one embodiment of the present invention, a golf putter includes a shaft having a handle end and a putter head end wherein the handle end and the putter head end of the shaft are at an angle from between about 10 degrees to about 12 degrees to one another, a putter head of a first density having a ball striking side, a rear side, two ends, two upwardly extending ears each having at least one golf ball guide receiving slot, a top surface, a bottom surface, a top half and a bottom half, at least one golf ball guide positioned within the golf ball guide receiving slots, at least one weight having a second density where the second density is greater than the first density of the putter head wherein the weight is positioned within the putter head thereby lowering the center of gravity of the putter head below the center of the putter head, and wherein the top surface of the putter head includes a shaft receiving recess adapted to receive the putter head end of the shaft.

In another embodiment of the present invention, the golf putter includes a shaft having a handle end and an at least partially threaded putter head end wherein the handle end and the putter head end of the shaft are at a shaft angle from about 10 degrees to about 20 degrees to one another, a putter head of a first density having a ball striking side, a rear side, two ends, two upwardly extending ears each having at least one golf ball guide receiving slot, a top surface, a bottom surface, a top half and a bottom half wherein the ball striking side of the putter extends upward from the bottom surface at an angle of 89–86 degrees from the bottom surface thereby creating an angle that imparts top spin to a golf ball when stuck by the ball striking side of the putter head, at least one golf ball guide positioned within the golf ball guide receiving slots, a weight receiving channel positioned longitudinally in the bottom half of the putter head, a weight having a second density where the second density is greater than the first density of the putter head wherein the weight is within the channel thereby lowering the center of gravity of the putter head below the center of the putter head, and wherein the top surface of the putter head includes a recess adapted to receive and interact with the putter head end of the shaft.

In yet another embodiment of the present invention, a golf putter comprises a shaft having a handle end and an at least partially threaded putter head end wherein the handle end and the putter head end of the shaft are at a shaft angle from about 10 degrees to about 12 degrees to one another, a putter head of a first density having a first ball striking side, a second ball striking side opposite the first ball striking side, two ends, two upwardly extending ears each having at least one golf ball guide receiving slot, a top surface, a bottom surface, a top half and a bottom half wherein the first and second ball striking sides of the putter extend upward from the bottom surface at an angle of 89–86 degrees from the bottom surface thereby creating an angle that imparts top spin to a golf ball when stuck by either the ball striking side of the putter head thereby allowing the same putter to be used by either a left or right handed golfer, at least one golf ball guide positioned within the golf ball guide receiving slots, a weight receiving channel positioned longitudinally in the bottom half of the putter head, a weight having a second density where the second density is greater than the first density of the putter head, wherein the weight is within the channel thereby lowering the center of gravity of the putter head below the center of the putter head, and wherein the top surface of the putter head includes a recess adapted to receive and interact with the putter head end of the shaft.

These and other features, advantages and objects of the present invention will be further understood and appreciated by those skilled in the art by reference to the following specification, claims, and appended drawings.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by, the claims, nor is it intended to be limiting as to the scope of the invention in any way.

The fundamental aspects of the invention, along with the various features and structures that characterize the invention, are pointed out with particularity in the claims annexed to and forming a part of this disclosure. For a better understanding of the negative loft fulcrum-balanced putter assembly of the present disclosure, its advantages and the specific objects attained by its uses, reference should be had to the accompanying drawings and descriptive matter in which there are illustrated preferred embodiments of the invention.

While embodiments of the golf putter assembly are herein illustrated and described, it is to be appreciated that various changes, rearrangements and modifications may be made therein, without departing from the scope of the invention as defined by the appended claims.

DETAILED DESCRIPTION OF PREFERRED EMBODIMENTS

Figure 1:
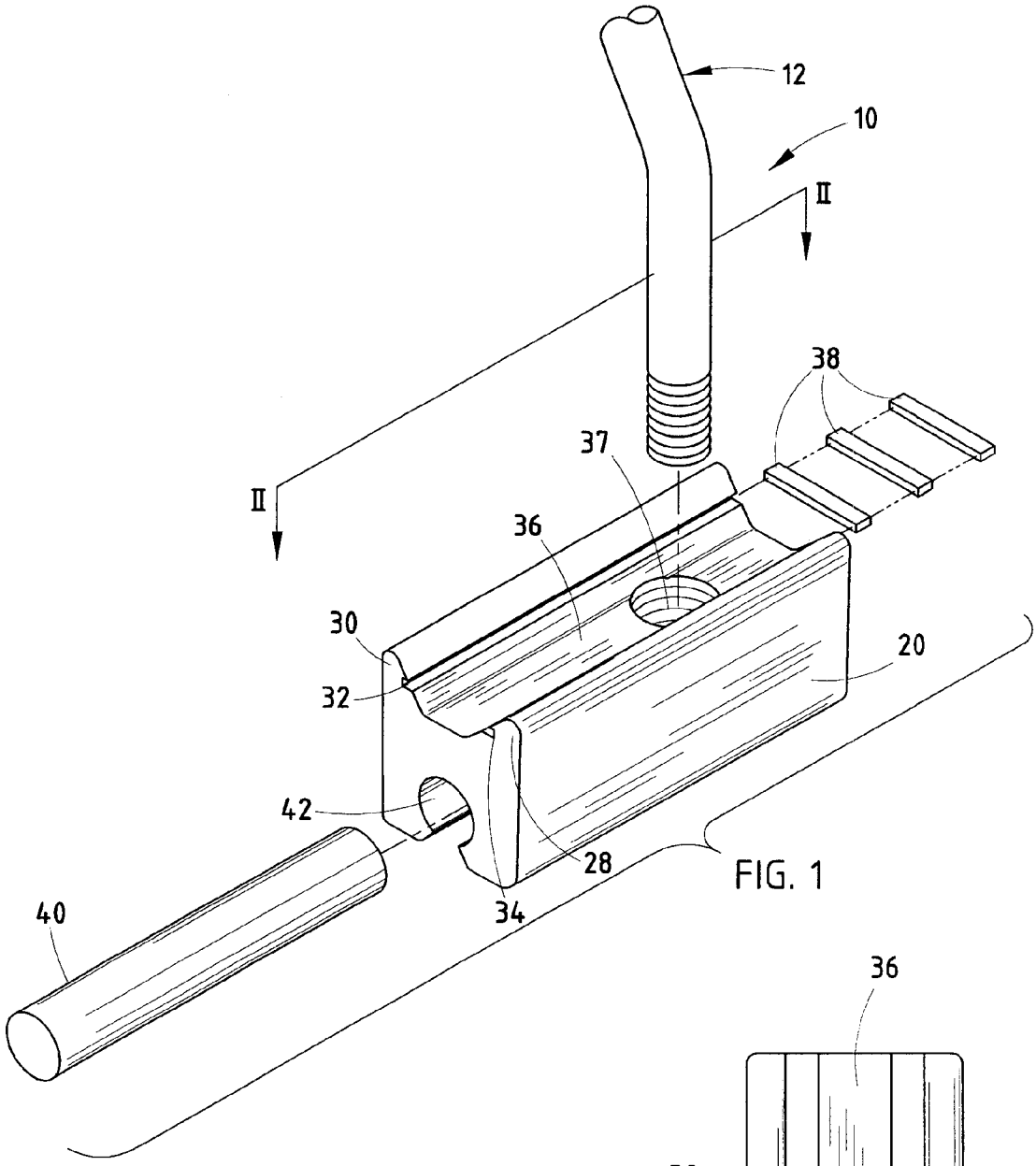
FIG. 1 is an exploded perspective view of the putter.
Figure 2:
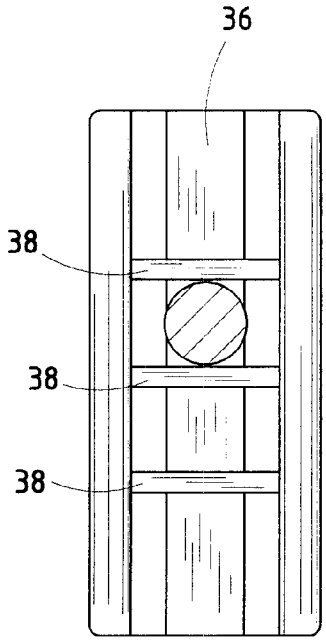
FIG. 2 is a top view of the putter head.
Figure 3:
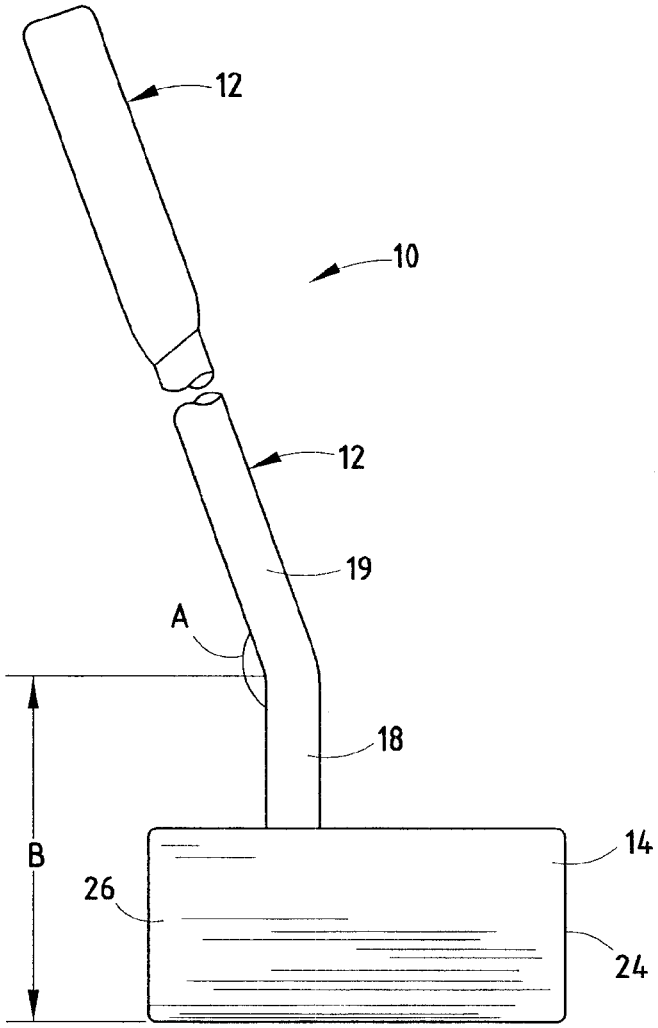
FIG. 3 is an elevated side view of the putter head and shaft.

The golf putter 10 generally includes a shaft 12 and a putter head 14. Shaft 12 includes a handle end 16 and a putter head end 18. The putter head end 18 and the shaft end 19 are bent at a shaft angle A (lie angle) from about 10 degrees to about 12 degrees, preferably about 10 degrees. Distance B (FIG. 3) is preferably about 5 inches or less. The entire weight of the putter is preferably about 15 oz.

The shaft is cylindrical, hollow, and has a diameter of ½ inch. The shaft is preferably made of 0.035 inch wall aluminum tubing, but any suitable material may be used. While most all prior art putters have tapered shafts, shaft 12 is preferably not tapered, but rather is ½ inch in diameter through its entire length. Attached to the handle end of the shaft is a grip that weighs about 55 grams (1.94 oz.). Preferably, the handle is a Winn Grip. The putter head end of the shaft is at least partially threaded.

The putter head 14 is preferably manufactured of extruded anodized aluminum. Preferably, the putter head is about 4 inches long. The putter head includes a golf ball striking side 20, a rear side 22, two ends 24, 26, and two upwardly extending ears 28, 30 along the length of the putter head. Golf ball sight guide slots 32, 34 for receiving golf ball sight guides preferably extend the length of each ear. However, the golf ball sight guide receiving slots could be single slots with the number of slots corresponding to the number of golf ball sight guides used in the putter head.

The upwardly extending ears 28, 30 define a trough 36. In the preferred embodiment, the trough 36 extends the length of the putter and includes a recess 37, which is preferably adapted to receive the putter head end of the shaft. The recess 37 is typically about ⅜" deep and about ½" in diameter, preferably slightly larger than the width of the trough. Consequently, the shaft works in cooperation with the ears to provide further support for one another. Preferably, the putter head end of the shaft and the recess are threadably engaged when connected. Optionally, a second recess could be spaced in the trough 36. The second recess would allow a left or right handed user to use the same golf putter. The recesses or single recess are positioned such that the outer edge of the shaft and the outer edge of the recess are substantially adjacent to the center of the putter head. The recess or recesses and the shaft are not placed over the center of the golf putter head as this would block the view of the golf ball sight guides and potentially the golfer's view of the golf ball itself when the golfer is standing behind the golf ball. Having the recesses displaced off center allows the golfer to align the putt more easily in the golfer's natural sight line.

The golf ball sight guides 38 are preferably elevated to approximate the height of the ball, which is slightly higher than the height of the ball striking side and rear side of the putter head. The diameter of a golf ball is typically about 1.6–1.7 inches. Preferably, three golf ball sight guides 38 may be positioned in a corresponding number of golf ball guide receiving slots, or in the preferred embodiment as shown, along the slots 32, 34, which extend the length of the upwardly extending ears. Preferably, the three golf ball sight guides are spaced such that two guides 38 mark the outer boundaries of the sweetest spot on the putter head and are spaced a distance approximately equal to the diameter of the golf ball from one another. The center sight guide, which is preferably spaced in the center of the putter head or the center of the sweet spot, is equidistant from the other two guides and marks the center of the golf ball. When aligned with the manufacturer's name on a golf ball, the center sight guide assists the golfer in making his/her putt because the printed golf ball manufacturer's name provides a straight follow through line on the ball to match the center sight guide. Optionally, one golf ball sight guide may be used to mark the center of the golf mark or two golf ball sight guides may be used with the center of the golf ball guides omitted. However, three guides are most preferred. Preferably, the golf ball sight guides are a different and visually distinct color than the putter head. The difference in color provides a clearer visual aid to the golfer. The different color and the fact that the golf ball sight guides are elevated above the trough provide an excellent, easily seen, alignment tool for the golfer.

The golf ball striking side 20 and the rear side 22 of the putter head include a bottom edge. The bottom edge is preferably curved or beveled along the entire bottom edge. The curvature or beveling assists in the prevention of stubbing of the golf putter while in use.

Figure 4:
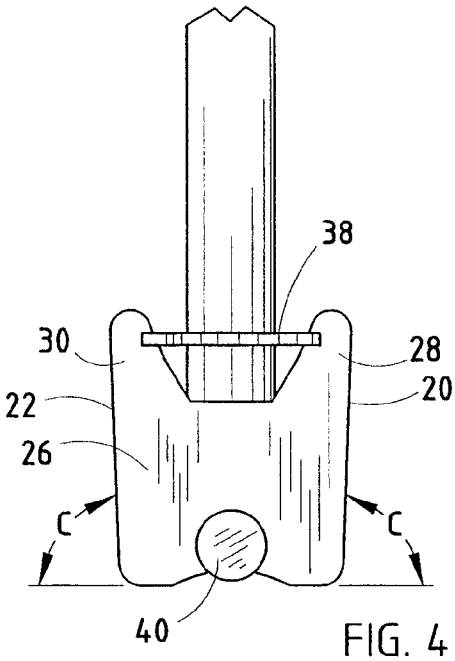
FIG. 4 is an elevated end view of the putter head and shaft.
Figure 5:
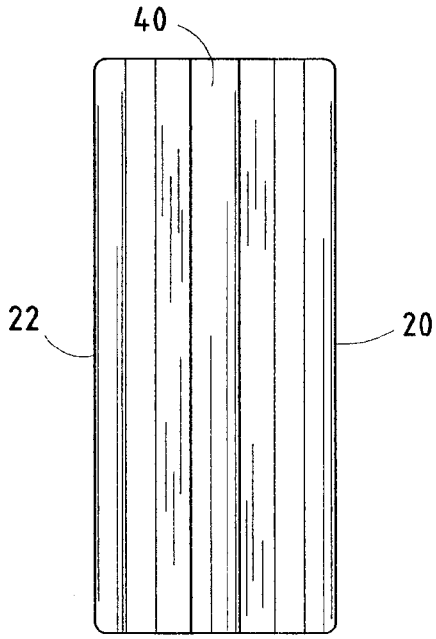
FIG. 5 is an elevated bottom view of the putter head.

Preferably, the ball striking side and the rear side extend upward from the bottom edge at an angle of between 89 and 87 degrees (angle C in FIG. 4), preferably 88 degrees, from the plane defined by the bottom surface. The rear side, especially when two recesses are used to make the putter a left or right handed putter, may also be used to strike the golf ball. Alternatively, when only one of the striking or rear sides are provided with a negative loft, two recesses can be used to make the putter a left or a right handed putter. The angle C of both the rear side 22 and golf ball striking side 20 induces an immediate top spin from the moment of impact on the ball, resulting in directional inertia caused by the design.

A weight, preferably a steel rod 40, which is more dense than the aluminum extruded putter head, is inserted into a receiving channel 42 that extends longitudinally along the length of the putter head. Receiving channel 42 is preferably about ⅜" in diameter. A slot in the weight-receiving channel facilitates insertion of the weight into the weight-receiving channel. The weight is preferably a steel rod, but could be any material of greater density than the putter head. Steel rod 40 is preferably ⅜ inch in diameter and preferably extends the length of the putter head 14. Steel rod 40 preferably weighs from about 1.5–2.5 oz, but most preferably about 2.0 oz.

Figure 6:
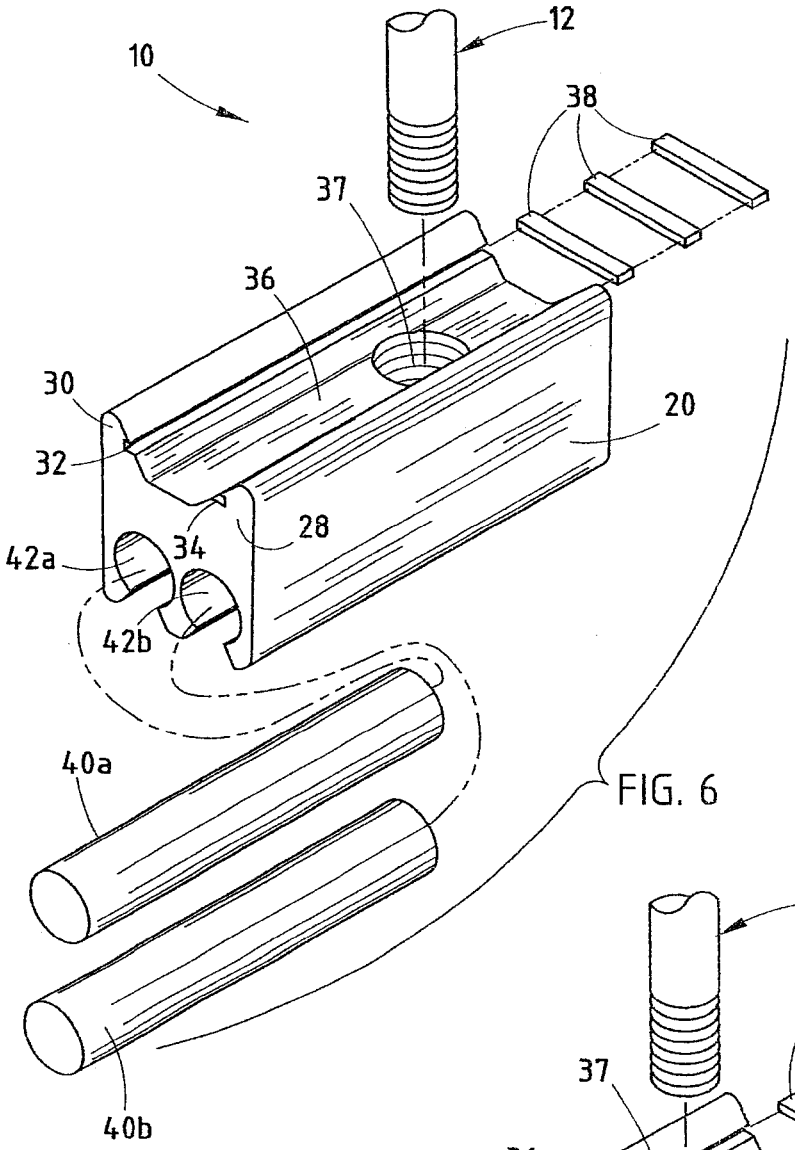
FIG. 6 is an exploded perspective view of another embodiment of the putter.

In another embodiment (see FIG. 6), two or more weight receiving channels 42*a,* 42*b,* and a corresponding number of weights, preferably steel rods, are positioned within the channels.

Figure 7:
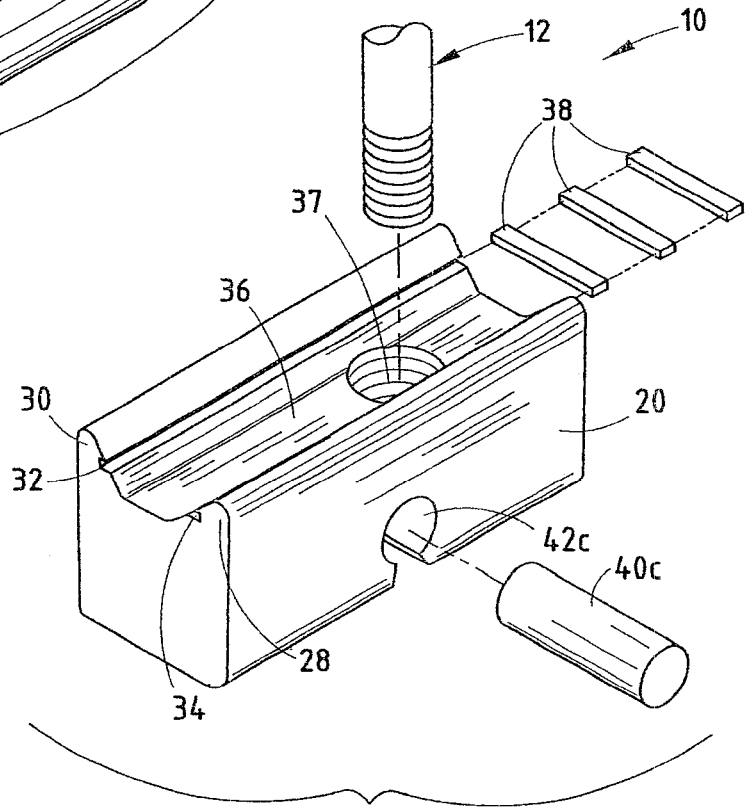
FIG. 7 is an exploded perspective view of another embodiment of the putter.

In yet another embodiment (see FIG. 7), at least one weight receiving channel 42*c* and a corresponding number of weights 40*c* are positioned laterally within the bottom half of the putter head. The weights may extend completely through the bottom half of the putter and have front and back ends that may form part of the ball striking surface.

The insertion of the steel rod accomplishes a number of benefits. The insertion of the steel rod lowers the center of gravity of the putter head below the center of the golf ball to be struck. This also lowers the sweet spot on the putter head. This is especially significant because a golfer must raise the putter head slightly off the ground to avoid stubbing. Consequently, when the putter head of the present invention strikes a ball, the center of the sweet spot is more likely to translate through and strike the center of the ball. This further assists the inducement of immediate top spin on the ball, as discussed above, thereby maintaining the direction of a putt once the putt has been struck more effectively than prior art putter heads having angled striking surfaces.

Furthermore, the steel rod improves the feel of the putter in the golfer's hand and prevents torque when the ball is struck considerably off center. Optionally, there may be more than one weight extending laterally through the width of the putter head instead of through the length of the putter head, which operates to achieve the same result.

The precisely weighted putter head and the precise angle of the shaft produce a fulcrum-balanced putter. The fulcrum-balance point is the point at which the putter is suspended on the shaft with gravity dictating the point at which the sole of the putter will be parallel to a flat surface. The putter of the present invention has a fulcrum-balance point about 1¾ inch from the centerline. The muscles used mainly with my putter are the ones in the arms to take the putter back and through the putt. Very little muscle tension is needed in an upward motion to support the putter in comparison to typical standard length putters. Since putting is very much a tension and feel stroke, this aids the golfer immeasurably in making a smooth and accurate stroke. The fulcrum-balanced putter operates to move the center of the head of the putter as close as possible to a pendulum motion, which is easiest for a putter to accurately execute, while still being within the regulation of the golfing industry.

The solutions offered by the invention herein have thus been attained in an economical, practical, and facile manner. While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed is:

1. A golf putter comprising:

a shaft having a handle end and a putter head end wherein the handle end and the putter head end of the shaft are at an angle from between about 10 degrees to about 12 degrees to one another;

a putter head of a first density having a ball striking side, a rear side, two ends, two upwardly extending ears each having at least one golf ball guide receiving slot, a top surface, a bottom surface, a top half and a bottom half;

at least one golf ball guide positioned within the golf ball guide receiving slots;

at least one weight having a second density where the second density is greater than the first density of the putter head wherein the weight is positioned within the putter head thereby lowering the center of gravity of the putter head below the center of the putter head; and wherein the top surface of the putter head includes a shaft receiving recess adapted to receive the putter head end of the shaft.

2. The golf putter of claim 1 further comprising at least one golf ball guide receiving slot and at least one golf ball guide positioned within the golf ball guide receiving slots.

3. The golf putter of claim 1, wherein the handle end and the putter head end of the shaft are at an angle from about 10 degrees to one another.

4. The golf putter of claim 1, further comprising at least one weight receiving channel positioned in the bottom half of the putter head and a corresponding number of weights spaced within the at least one channel.

5. The golf putter of claim 4, further comprising two or more weight receiving channels and wherein a corresponding number of weights are positioned within the channels.

6. The golf putter of claim 4, wherein the at least one weight receiving channel and the weights are positioned laterally within the bottom half of the putter head.

7. The golf putter of claim 4, wherein the channels and weights are positioned longitudinally within the bottom half of the putter head.

8. The golf of claim 4, wherein the at least one channel includes a corresponding number of slots.

9. The golf putter of claim 1, wherein the at least one weight further comprises front and back ends and the channels and weights completely extend through the bottom half of the putter such that the front and back ends of the weights form part of the ball striking surface.

10. The golf putter of claim 1, wherein the weight is steel.

11. The golf putter of claim 10, wherein the putter head is aluminum.

12. The golf putter of claim 10, wherein the shaft receiving recess of the putter head is threadably engaged with the putter head end of the shaft.

13. The golf putter of claim 1, comprising two outer golf ball guides positioned within the golf ball guide receiving slots such that they are spaced apart marking the diameter of a golf ball thereby aiding the golfer in aligning a putt.

14. The golf putter of claim 13, further comprising a center golf ball guide positioned within the golf ball guide slots such that the center golf ball guide is spaced equidistant from the two outer golf ball guides thereby marking the center of a golf ball.

15. The golf putter of claim 14, wherein the center golf ball guide is aligned with the center of the putter head between the two ends of the putter head.

16. The golf putter of claim 15, wherein the golf ball guide receiving slots of both ears extend longitudinally along the entire length of the ears.

17. The golf putter of claim 1, wherein the ball striking side and the rear side of the putter head further includes curvilinear bottom edges.

18. The golf putter of claim 1, wherein the ball striking side and the rear of the putter head further includes beveled bottom edges.

19. The golf putter of claim 1, wherein the shaft receiving recess is positioned on the top surface of the putter head and substantially adjacent to the center of the putter head.

20. The golf putter of claim 1, wherein the shaft is a cylindrical tube structure having a wall thickness of about 0.035 inch and a diameter of about ½ inch.

21. The golf putter of claim 1, wherein the shaft is a cylindrical tube structure having a wall thickness of about 0.035 inches.

22. A golf putter comprising:

a shaft having a handle end and an at least partially threaded putter head end wherein the handle end and the putter head end of the shaft are at a shaft angle from about 10 degrees to about 20 degrees to one another;

a putter head of a first density having a ball striking side, a rear side, two ends, two upwardly extending ears each having at least one golf ball guide receiving slot, a top surface, a bottom surface, a top half and a bottom half wherein the ball striking side of the putter extends upward from the bottom surface at an angle of 89–86 degrees from the bottom surface thereby creating an angle that imparts top spin to a golf ball when struck by the ball striking side of the putter head;

at least one golf ball guide positioned within the golf ball guide receiving slots;

a weight-receiving channel positioned longitudinally in the bottom half of the putter head;

a weight having a second density where the second density is greater than the first density of the putter head wherein the weight is within the channel thereby lowering the center of gravity of the putter head below the center of the putter head; and wherein the top surface of the putter head includes a recess adapted to receive and interact with the putter head end of the shaft.

23. The golf putter of claim 22, wherein the negative loft angle is about 88 degrees.

24. The golf putter of claim 23, wherein the ball striking side and the rear side of the putter head further includes curvilinear bottom edges.

25. The golf putter of claim 22, wherein the shaft angle is about 10–12 degrees.

26. The golf putter of claim 22, further comprising two outer golf ball guides positioned within golf ball guide receiving slots such that they are spaced apart marking the diameter of a golf ball thereby aiding the golfer in aligning a putt.

27. The golf putter of claim 26, further comprising a center golf ball guide positioned within golf ball guide slots such that the center golf ball guide is spaced equidistant from the two outer golf ball guides thereby marking the center of a golf ball and wherein the center golf ball guide is aligned with the center of the putter head between the two ends of the putter head.

28. The golf putter of claim 22, wherein the golf ball guide receiving slots of both ears extend longitudinally along the entire length of the ears.

29. The golf putter of claim 22, wherein the weight is steel.

30. The golf putter of claim 29, wherein the putter head is aluminum.

31. The golf putter of claim 29, wherein the shaft receiving recess of the putter head is threadably engaged with the putter head end of the shaft.

32. The golf putter of claim 22, wherein the ball striking side and the rear of the putter head further includes beveled bottom edges.

33. The golf putter of claim 22, wherein the shaft receiving recess is positioned on the top surface of the putter head and substantially adjacent to the center of the putter head whereby a golfer can more easily align the golf ball with the center of the putter head due to the absence of the shaft over the center of the putter head.

34. The golf putter of claim 22, wherein the weight receiving channel has a slot.

35. A golf putter comprising:

a shaft having a handle end and an at least partially threaded putter head end wherein the handle end and the putter head end of the shaft are at a shaft angle from about 10 degrees to about 12 degrees to one another;

a putter head of a first density having a first ball striking side, a second ball striking side opposite the first ball striking side, two ends, two upwardly extending ears each having at least one golf ball guide receiving slot, a top surface, a bottom surface, a top half and a bottom half wherein the first and second ball striking sides of the putter extend upward from the bottom surface at an angle of 89–86 degrees from the bottom surface thereby creating an angle that imparts top spin to a golf ball when struck by either the ball striking side of the putter head thereby allowing the same putter to be used by either a left or right handed golfer;

at least one golf ball guide positioned within the golf ball guide receiving slots;

a weight-receiving channel positioned longitudinally in the bottom half of the putter head;

a weight having a second density where the second density is greater than the first density of the putter head;

wherein the weight is within the channel thereby lowering the center of gravity of the putter head below the center of the putter head; and wherein the top surface of the putter head includes a recess adapted to receive and interact with the putter head end of the shaft.

36. The golf putter of claim 35, wherein the first and second ball striking sides of the putter head further include curvilinear bottom edges thereby lowering the chance that a person putting will stub a putt by hitting the ground before hitting the ball.

* * * * *

UNITED STATES PATENT AND TRADEMARK OFFICE

CERTIFICATE OF CORRECTION

PATENT NO. : 6,440,006 B1
DATED : August 27, 2002
INVENTOR(S) : Vernon R. Johnson It is certified that error appears in the above-identified patent and that said Letters Patent is hereby corrected as shown below:

Column 6,
Line 40, after "golf" insert -- putter --.

Signed and Sealed this

Eleventh Day of March, 2003

JAMES E. ROGAN
*Director of the United States Patent and Trademark Office*